United States Patent [19]

Verdon et al.

[11] Patent Number: 4,980,982

[45] Date of Patent: Jan. 1, 1991

[54] PICTURE FRAME SUITABLE FOR MAILING

[76] Inventors: James F. Verdon; Daniel Firestein, both of 10183 Boca Bend East, Boca Raton, Fla. 33428

[21] Appl. No.: 902,144

[22] Filed: Aug. 29, 1986

[51] Int. Cl.[5] ..... A47G 1/06; G09F 1/12

[52] U.S. Cl. ..... 40/154; 40/152.1; 40/152; 40/611; 40/661; 40/649

[58] Field of Search ..... 40/152, 152.1, 10 R, 40/10 D, 155, 156, 611, 647, 649, 661, 158.1

[56] References Cited

U.S. PATENT DOCUMENTS

| | | | |
|---|---|---|---|
| 3,973,343 | 8/1976 | Tolfsen | 40/152.1 |
| 4,212,122 | 7/1980 | Reim | 40/152.1 |
| 4,310,976 | 1/1982 | Wilten | 40/10 D |
| 4,441,268 | 4/1984 | Scott | 40/10 D |

*Primary Examiner*—Kenneth J. Dorner
*Assistant Examiner*—J. Hakomaki
*Attorney, Agent, or Firm*—Harry W. Barron

[57] ABSTRACT

Disclosed herein is a picture frame made entirely of injection molded transparent plastic material. The frame includes a generally planar front side and a back side divided into a viewing area and a border area. The viewing area is generally planar and the border area has corner support and positioning members extending from each of the four corners and a holding member extending from the central part of each of the sides. The holding member includes a positioning portion for assisting and positioning a picture and backing card to be inserted into the frame and extensions for holding the picture and backing card in place once positioned. In addition, the backing card includes a perforated line and two bend lines. Spacing between the corner members and support members allows a finger to break a perforated line and bend a portion of the perforation to form a stand for displaying the picture. Further, each of the extensions includes a Vee groove to allow the frame to be hung on a conventional picture hanger or nail. The frame, including the backing card, is designed to be of a weight and size acceptable for mailing as a lowest weight post card item of mail.

20 Claims, 2 Drawing Sheets

PICTURE FRAME SUITABLE FOR MAILING

This invention relates to a picture frame and more particularly to an integral injection molded frame adapted for holding a picture in a frame which is suitable for mailing in the lowest weight class.

Picture frames are probably as old as pictures themselves. Picture frames provide two important advantages to a picture which are protecting the picture and providing a convenient manner for displaying the picture. Pictures are also suitable for being mailed through the United States Postal Service in a form generally referred to as a post card. Such a card typically includes a picture on one side and two areas on the opposite side respectively adapted for writing a message and addressing the card. Postal restrictions limit what can be sent through the mail for the price of a post card by weight and size categories.

In the past, the desire to utilize only a single stamp in the lowest weight class allowed has limited the ability to send framed post cards through the mail at the lowest post office rate. In addition, a conventional photograph, such as a family photograph, cannot be easily sent through the mail at the post card rate since the back is not appropriate for addressing. By not including a frame around the picture being sent, the danger always exists that the picture will be bent or mishandled during the period of time it is in the possession of the post office. Furthermore, once the picture is received by the recipient, it is difficult to properly display a picture or post card without some type of frame. Hence, the recipient must buy a frame in order to properly display the card. Depending upon the desires of the recipient, the frame would include either, or both, a stand for standing the frame on a flat surface or a means for hanging the frame from a wall hook or nail.

People have solved the problem of framing pictures for mailing by including a paper or cardboard type frame with the picture and inserting the framed picture within a large envelope and mailing that envelope. This creates unnecessary postage since the price of a first class letter is fifty percent greater than the price of a post card. Others have designed such paper frames to be suitable for mailing without an added envelope. In either case, the paper frame is not as durable as may be desired and can be destroyed during automatic sorting. Examples of such prior art picture folders include U.S. Pat. Nos. 896,231, 2,576,667, 3,762,630, 2,219,492, 2,542,278, 2,388,431, and 2,958,971. Of particular interest is U.S. Pat. No. 2,219,492 which incorporates a fold-out paper mailer with a frame for holding a picture. Such a device would be difficult to utilize with the automated sorting equipment currently used in the post office. Such equipment includes rollers through which the mail moves. These rollers would disassemble the frames of the prior art, potentially causing the unaddressed picture to become separated, and hence lost, from the mailer frame. Further, the prior art does not provide an all purpose frame for either displaying a picture on a table or hanging the picture on a wall. Another similar type mailer is shown in U.S. Pat. No. 3,762,630 which suffers from many of the same disadvantageous of the early patent.

In accordance with one aspect of this invention there is provided an integral injection molded frame suitable for mailing a picture comprising a planar front viewing surface and a picture receiving surface opposite to the viewing surface. The receiving surface has a border area and a planar viewing area. Corner supports extend outward from the receiving surface and are positioned totally within the border area. In addition, a plurality of picture holding means extend outward from the receiving surface from within the border area. Further, the border area includes at least a portion thereof separating each of the holding means from the support means on the same plane as the viewing area.

One preferred embodiment of the subject invention is hereafter described with specific reference being made to the following Figures, in which.

Figure 1:
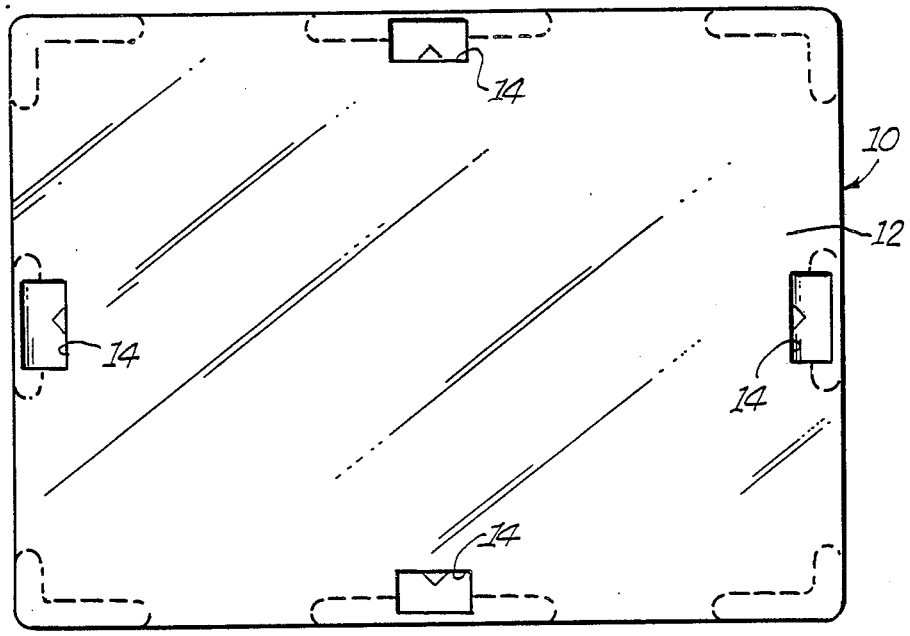
FIG. 1 is a view of the front of the injection molded frame of the subject invention.
Figure 2:
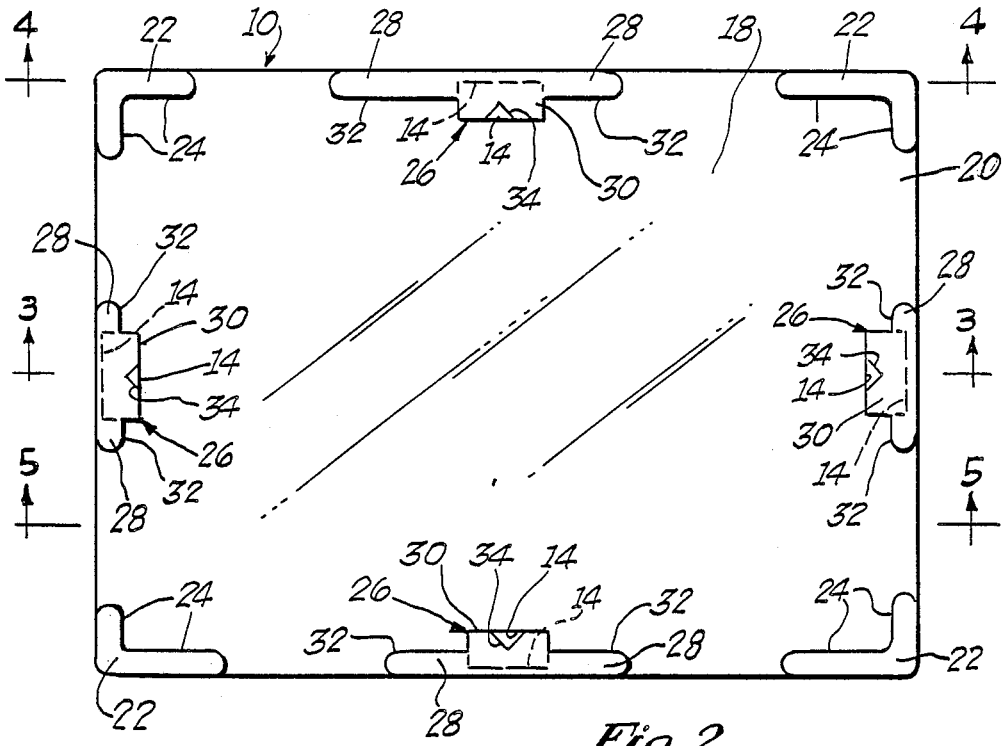
FIG. 2 is a view of the back of the frame of the subject invention.

Referring now to FIGS. 1 and 2, the front and back views respectively of the frame 10 are shown. Frame 10 is a single piece of injection molded plastic preferably of a clear plastic material, such as Butadiene mixed with Styrene. The front surface 12 of frame 10 is generally flat except for four openings 14 positioned generally in the center of the four sides of frame 10 slightly away from the edge of frame 10. As will be explained hereafter, openings 14 are included in order to form the picture or backing holding mechanism on the reverse side of frame 10 during the molding procedure. These holes may be replaced with molds with lateral moving members.

Figure 3:
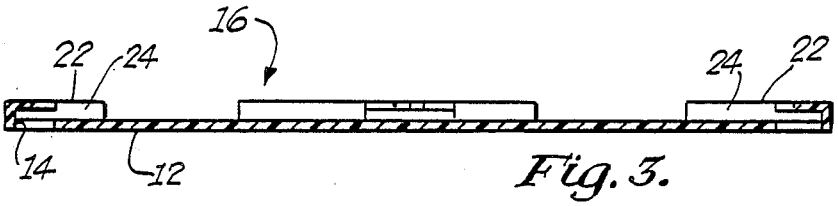
FIG. 3 is a cross-sectional view taken across lines 3—3 of FIG. 2.
Figure 4:
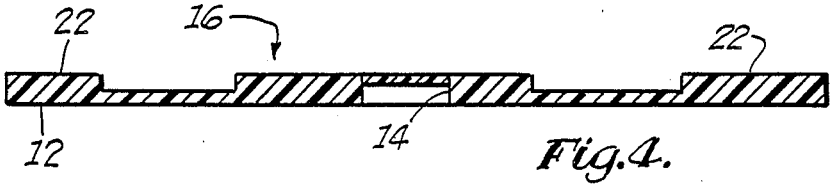
FIG. 4 is a cross-sectional view taken across lines 4—4 of FIG. 2.
Figure 5:
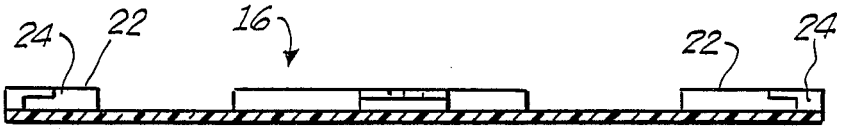
FIG. 5 is a cross-sectional view taken across lines 5—5 of FIG. 2.

Referring now to FIG. 2, the back side of frame 10 is shown. It should be noted that in FIG. 1 and FIG. 2 features on the opposite side of the view shown in the respective figure are shown in dotted lines in that respective figure. Reference is also made to FIGS. 3, 4 and 5 which show the various features in cross-sectional view taken across the respective lines 3—3, 4—4 and 5—5.

The back side 16 of frame 10 includes generally a viewing area 18 and a border area 20. All of the elements to be hereafter described extend from the border area 20 leaving the viewing area 18 clear for viewing the picture to be inserted on the back side 16 of frame 10. While not shown in the Figures, it may be desirable to reduce the thickness of the plastic within the viewing area 18 from that in the border area 20. Since the thickness of the plastic provides the strength required for the various elements to be described hereafter, the border area must be of a certain minimum thickness for strength purposes, whereas the generally flat transparent viewing area need only have sufficient plastic to allow proper molding. Further, the reduction of the plastic material reduces the overall weight of the injected molded frame, thereby allowing heavier backing materials as shown in FIG. 6, and pictures to be inserted and still be mailed in the lowest post card weight class.

Each of the four corners of frame 10 include a support and positioning member 22 extending outward from the back side 16. Each of members 22 provide the dual function of support for the corners of frame 10 as well as providing a vertical surface 24 against which to position a backing. Positioned between each of the members 22, is a backing holding member 26. Holding member 26 includes a base and positioning member 28 extending behind and laterally from both sides of hole 14 in the border area 20. An extension 30 extends towards viewing area 18 from the portion of member 30 behind hole 14 and is positioned to be above the surface of back side 16. Member 28 includes a vertical surface 32 on both sides of hole 14 which surface 32 in line with the vertical surfaces 24 of support and positioning members 22. Cut within each of the extensions 32 generally in the center thereof is a Vee groove 34 which is adapted to allowing frame 10 to be hung on a wall by a nail or picture hook of conventional design. Vee groove 34 is included in each of the four extensions so that frame 10 can be held in any position. It should be noted that hole 14 is utilized to mold extension 30.

The general dimensions of frame 10 may vary depending upon the size of the picture to be inserted therein. For example, frame 10 may be four inches by five and one half inches. It may have a total thickness of approximately one-eighth of an inch and a thickness of the viewing area 18 of approximately 0.070 inches. The distance separating each of the support and positioning members 22 and the holding members 26 may be approximately one inch. As will be explained hereafter, this distance between members 22 and 26 may be utilized to fold a portion of the backing sheet to form a stand. Generally speaking the area between the members 22 and 26 is on the same plane as the viewing area 18 portion of the back side 16 of frame 10.

Figure 6:
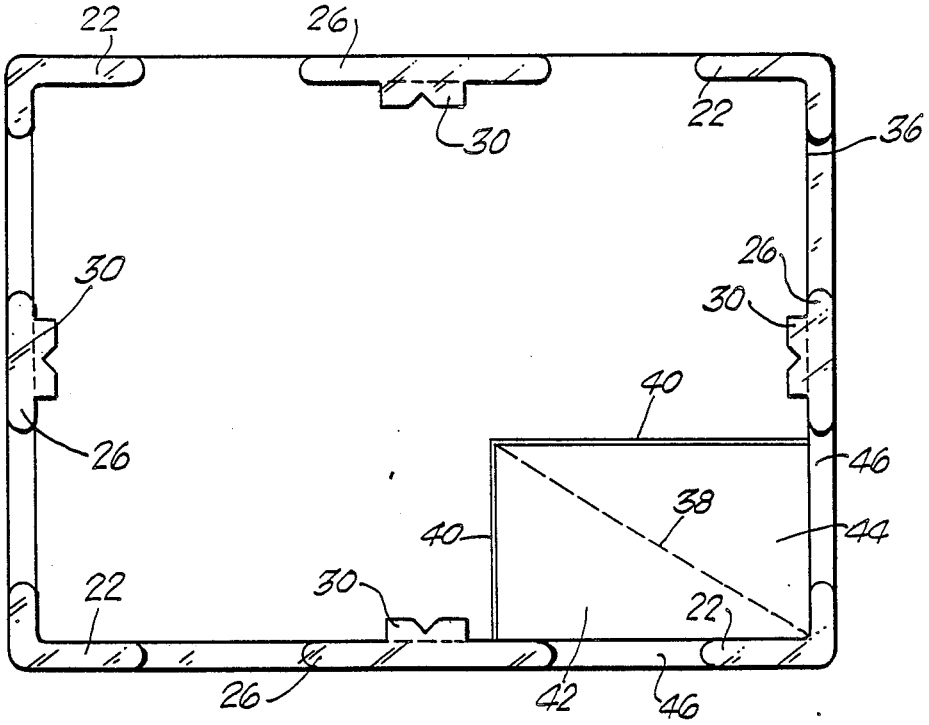
FIG. 6 is a view of the back of the frame of the subject invention having a backing member inserted therein.

Referring now to FIG. 6, a backing card 36 is shown inserted into back side 16 of frame 10. As is seen, card 36 is positioned by the vertical surfaces 24 and 32 associated with members 22 and 26 and is held in place by the extensions 30. Backing card 36 may have printed thereon the information conventionally found on a post card to allow a message area and an address and stamp area. The opposite side of backing 36 may contain a picture or a conventional photograph may be placed between the opposite side of backing 36 and the surface of viewing area 18. Backing 36 may include a perforated cut line 38 and a pair of bend lines 40 extending from the end of cut line 38 vertically toward the edge of card 36. Perforated cut line 38 and bend lines 40 should be sized and positioned so that when card 36 is placed into frame 10, as shown in FIG. 6, the bend lines 40 are positioned adjacent to but not beneath the extensions 30. Thus, two triangular portions 42 and 44 on backing 36 are formed. When the user of frame 10 desires to display a photograph placed beneath backing 36 on a table, the user may insert a finger in the space 46 between the appropriate members 22 and 26 and lift up one of the formed triangular portions 42 or 44 of backing 36. This will cause the perforated cut to break completely and one of the two portions 42 or 44 thereby formed will be bent along the associated one of the bend lines 40 to form a stand.

Preferably, cut line 38 and bend lines 40 are to be placed on the portion of the backing 30 that is utilized for address purposes, thereby leaving the message portion of the card intact. However, because of the blank area between each of the members 22 and members 26, backing 36 still may be inserted into frame 10 in any direction. Further, by making the spacing and positioning of each of the members 22 and 26 the same, the portions 42 or 44 may be conveniently torn away and bent to form a stand in either the horizontal or vertical direction of frame 10 depending on the picture to be displayed. Alternatively, of course, frame 10 could be hung from a wall hook utilizing the Vee areas 34 of extensions 30 and the portions 42 and 44 would be left intact.

It is important to maintain the cut line 38 in a position such that the rollers used in automatic mail sorting machines do not cause the perforations to be bent. Thus, cut line 38 should not be positioned so as to be parallel to the rollers. The angular positioning of line 38, as seen in FIG. 6, solves this problem.

What is claimed is:

1. An integral injection molded frame suitable for mailing a picture, comprising:

a planar front surface;

a picture receiving surface opposite to said front surface, said receiving surface having a border area and a planar viewing area;

corner supports extending outward from said receiving surface and positioned totally within said border area; and a plurality of picture holding means extending outward from said receiving surface from within said border area, said border area having at least a portion thereof between each of said holding means and said supports on the same plane as the viewing area.

2. The invention according to claim 1 further including a backing member sized to fit into said planar viewing area of said receiving surface and to be positioned by said corner supports and held by said holding means.

3. The invention according to claim 2 wherein said backing member includes a cut therein extending from the edge thereof and a bend line extending from said cut to a different part of said edge, whereby the area between said cut and bend line form a stand when said backing is bent on said bend line.

4. The invention according to claim 3 wherein said different part of said edge is aligned with said portion of said border area on the same plane as said viewing area.

5. The invention according to claim 4 wherein said different part of said edge is closer to a holding means than to a corner support.

6. The invention according to 4 wherein said different part of said edge is positioned at a sufficient distance remote from said corner support to permit a person's finger to lift the area of said backing member between said cut and bend line for subsequent bending around said bend line to form a stand.

7. The invention according to claim 6 wherein the space between said planar viewing area surface and said holding means is sufficient for a photograph and said backing member to be held.

8. The invention according to claim 7 wherein the weight of said frame and backing member is less than one ounce.

9. The invention according to claim 6 wherein the weight of said frame and backing member is less than one ounce.

10. The invention according to claim 2 wherein the weight of said frame and backing member is less than one ounce.

11. The invention according to claim 10 wherein the space between said planar viewing area surface and said holding means is sufficient for a photograph and said backing member to be held.

12. An injection molded combination frame and integral viewing area suitable for mailing a picture, comprising:

a planar front surface;

a picture receiving surface opposite to said front surface, said receiving surface having a border area and a planar viewing area;

a plurality of corner supports remote from one another, each extending outward from said receiving surface and positioned totally within said border area; and a plurality of picture holding means extending outward from said receiving surface from within said border area, said border area having at least a portion thereof between each of said holding means and said supports on the same plane as the viewing area.

13. The invention according to claim 12 further including a backing member sized to fit into said planar viewing area of said receiving surface and to be positioned by said corner supports and held by said holding means.

14. The invention according to claim 13 wherein said backing member includes a cut therein extending from the edge thereof and a bend line extending from said cut to a different part of said edge, whereby the area between said cut and bend line form a stand when said backing member is bent on said bend line.

15. The invention according to claim 14 wherein said different part of said edge is aligned with said portion of said border area on the same plane as said viewing area.

16. The invention according to claim 15 wherein said different part of said edge is closer to a holding means than to a corner support.

17. The invention according to 15 wherein said different part of said edge is positioned at a sufficient distance remote from said corner support to permit a person's finger to lift the area of said backing member between said cut and bend line for subsequent bending around said bend line to form a stand.

18. The invention according to claim 17 wherein the space between said planar viewing area surface and said holding means is sufficient for a photograph and said backing member to be held.

19. The invention according to claim 18 wherein the weight of said frame and backing member is less than one ounce.

20. The invention according to claim 17 wherein the weight of said frame and backing member is less than one ounce.

* * * * *